US011718496B2

(12) United States Patent
Nakahara

(10) Patent No.: US 11,718,496 B2
(45) Date of Patent: Aug. 8, 2023

(54) SHEET PROCESSING APPARATUS AND IMAGE FORMING SYSTEM

(71) Applicant: CANON KABUSHIKI KAISHA, Tokyo (JP)

(72) Inventor: Yasuhiro Nakahara, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/670,613

(22) Filed: Feb. 14, 2022

(65) Prior Publication Data

US 2022/0162034 A1 May 26, 2022

Related U.S. Application Data

(63) Continuation of application No. 17/063,803, filed on Oct. 6, 2020, now Pat. No. 11,279,586.

(30) Foreign Application Priority Data

Oct. 11, 2019 (JP) ..... 2019-188138

(51) Int. Cl.
*B65H 35/00* (2006.01)

(52) U.S. Cl.
CPC ..... *B65H 35/0086* (2013.01)

(58) Field of Classification Search
CPC ..... B65H 37/00; B65H 35/0086; B26F 1/02; B26F 1/0092
USPC ..... 270/58.07
See application file for complete search history.

(56) References Cited

U.S. PATENT DOCUMENTS 5,911,414 A 6/1999 Kato et al.
6,042,098 A 3/2000 Kubota et al.
6,361,036 B1 3/2002 Nakazawa
6,702,279 B2 3/2004 Adachi et al.
6,907,806 B1 6/2005 Okamoto et al.
7,134,370 B2 11/2006 Murata et al.
7,520,497 B2 4/2009 Moriyama et al.
9,144,915 B2 9/2015 Watanabe et al.
9,517,652 B2 12/2016 Kubota et al.
(Continued)

FOREIGN PATENT DOCUMENTS

CN 103287906 A 9/2013
CN 107934638 A 4/2018
(Continued)

OTHER PUBLICATIONS

Office Action dated Dec. 7, 2021, in Indian Patent Application No. 202044043575.
(Continued)

*Primary Examiner* — Leslie A Nicholson, III
(74) *Attorney, Agent, or Firm* — Venable LLP

(57) ABSTRACT

A sheet processing apparatus includes a conveyance portion, a punching portion, a moving portion, a first detecting portion, and a control unit configured to control the conveyance portion, the punching portion and the moving portion, wherein the control unit is configured, for a target position of each of a plurality of holes to be formed to a single sheet, to cause the first detecting portion to execute a detection process, and to execute a moving process of moving the moving portion based on the output value of the first detecting portion corresponding to the target position and a punching process of performing punching to the target position of the sheet by the punching portion after the moving process has been completed.

11 Claims, 11 Drawing Sheets

(56) References Cited

U.S. PATENT DOCUMENTS

| | | | |
|---|---|---|---|
| 10,022,885 | B2 | 7/2018 | Isogai |
| 10,155,322 | B2 | 12/2018 | Egawa |
| 10,562,732 | B2 | 2/2020 | Egawa |
| 2006/0145414 | A1 | 7/2006 | Yokobori et al. |
| 2018/0021968 | A1 | 1/2018 | Egawa |
| 2019/0292002 | A1 | 9/2019 | Takahashi |
| 2020/0387101 | A1 | 12/2020 | Koyama et al. |

FOREIGN PATENT DOCUMENTS

| | | | |
|---|---|---|---|
| JP | H07-112400 | A | 5/1995 |
| JP | H10-279170 | A | 10/1998 |
| JP | H10-330020 | A | 12/1998 |
| JP | 2004-142923 | A | 5/2004 |
| JP | 2009-161312 | A | 7/2009 |
| JP | 2012-246147 | A | 12/2012 |
| JP | 2013-237553 | A | 11/2013 |
| JP | 2015-199147 | A | 11/2015 |
| JP | 2016-078946 | A | 5/2016 |
| JP | 6177749 | B2 | 8/2017 |
| JP | 2017-210358 | A | 11/2017 |
| JP | 6384615 | B2 | 9/2018 |

OTHER PUBLICATIONS

Office Action dated Oct. 24, 2022, in Chinese Patent Application No. 202011079898.8.

Office Action dated May 23, 2023, in Japanese Patent Application No. 2019-188138.

SHEET PROCESSING APPARATUS AND IMAGE FORMING SYSTEM

This is a continuation of U.S. patent application Ser. No. 17/063,803, filed Oct. 6, 2020.

BACKGROUND OF THE INVENTION

Field of the Invention

The present invention relates to a sheet processing apparatus for processing sheets and an image forming system for forming images on sheets.

Description of the Related Art

In an image forming apparatus such as an electrophotographic multifunction machine, a sheet processing apparatus for performing processes such as a binging process and a sorting process to sheets to which images have been formed in a main body of the image forming apparatus has been adopted as an optional apparatus of the image forming apparatus.

Hitherto, a finisher that moves a punch blade unit in a width direction corresponding to sheet size and adjusting a punch hole forming position by detecting a side edge of the sheet using a side edge detection sensor has been proposed (refer to Japanese Patent Application Laid-Open Publication No. H10-279170). Further, a finisher that reads a hole position on a pre-punched sheet in advance using a scanner and moving a punch blade unit in a width direction so that punching can be performed at a same position as the hole position being read has been proposed (refer to Japanese Patent Application Laid-Open Publication No. 2009-161312).

However, the finishers disclosed in Japanese Patent Application Laid-Open Publication Nos. H10-279170 and 2009-161312 had a drawback in that if the sheets were conveyed to the punch blade unit in a skewed manner, the hole positions would be deviated in correspondence with the amount of skewing of the sheets. Especially in a case where a plurality of holes are punched on one sheet, the hole or holes on the upstream side in the sheet conveyance direction may be deviated greatly.

SUMMARY OF THE INVENTION

According to a first aspect of the present invention, a sheet processing apparatus includes a conveyance portion configured to convey a sheet in a sheet conveyance direction, a punching portion configured to perform punching to the sheet conveyed by the conveyance portion, a moving portion configured to move the punching portion toward an intersecting direction intersecting the sheet conveyance direction, a first detecting portion arranged upstream of the punching portion in the sheet conveyance direction and configured to perform a detection process of outputting an output value based on a position of an edge portion in the intersecting direction of the sheet being conveyed, and a control unit configured to control the conveyance portion, the punching portion and the moving portion, wherein the control unit is configured, for a target position of each of a plurality of holes to be formed to a single sheet, to cause the first detecting portion to execute the detection process, and to execute a moving process of moving the moving portion based on the output value of the first detecting portion corresponding to the target position and a punching process of performing punching to the target position of the sheet by the punching portion after the moving process has been completed.

According to a second aspect of the present invention, a sheet processing apparatus includes a conveyance portion configured to convey a sheet in a sheet conveyance direction, a punching portion configured to perform punching to the sheet conveyed by the conveyance portion, a moving portion configured to move the punching portion toward an intersecting direction intersecting the sheet conveyance direction, a detecting portion arranged upstream of the punching portion in the sheet conveyance direction and configured to perform a detection process of outputting an output value based on a position of an edge portion in the intersecting direction of the sheet being conveyed, and a control unit configured to control the conveyance portion, the punching portion and the moving portion, wherein during punching performed to a first target position and a second target position of a single sheet, the control unit is configured to execute a first moving process of moving the moving portion based on a first output value of the detecting portion corresponding to the first target position, a first punching process of performing punching to the first target position of the sheet by the punching portion after the first moving process has been completed, a second moving process of moving the moving portion based on a second output value of the detecting portion corresponding to the second target position after the first moving process, and a second punching process of performing punching to the second target position of the sheet by the punching portion after the second moving process has been completed.

Further features of the present invention will become apparent from the following description of exemplary embodiments with reference to the attached drawings.

DESCRIPTION OF THE EMBODIMENTS

Figure 1:
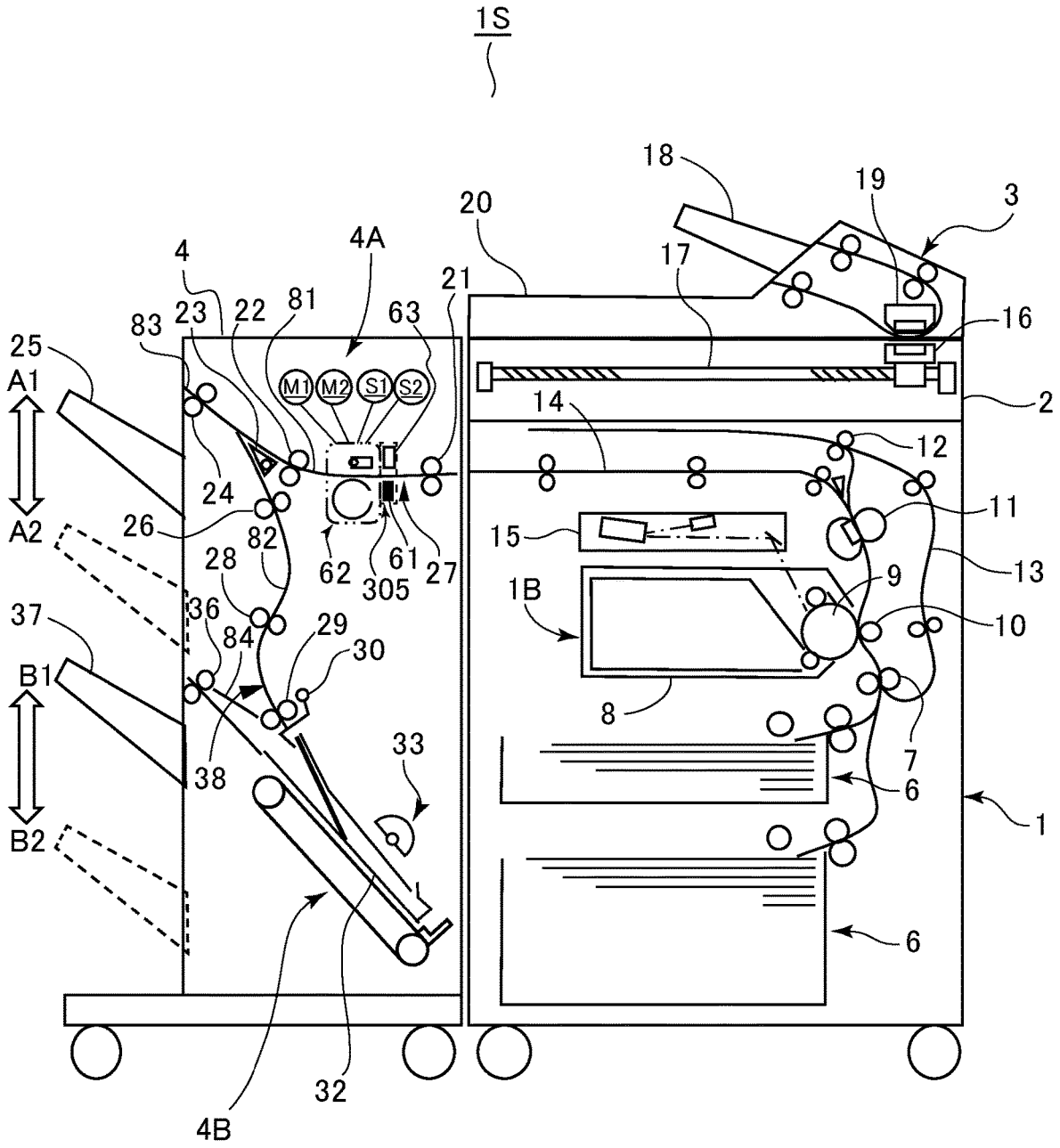
FIG. 1 is an entire schematic diagram illustrating an image forming system according to a first embodiment.

Now, an exemplary embodiment for carrying out the present invention will be described with reference to the drawings.

First Embodiment

General Configuration

An image forming system 1S according to a first embodiment is composed of an image forming apparatus 1, an image reading apparatus 2, a document feeder 3 and a finisher 4. The image forming system 1S forms an image on a sheet serving as a recording material and outputs the sheet after subjecting the sheet to processing by the finisher 4 if necessary. In the following description, simplified actions of various apparatuses will be described first and detailed descriptions of the finisher 4 will follow.

The document feeder 3 conveys a document placed on a document tray 18 to image reading units 16 and 19. The image reading units 16 and 19 are image sensors that respectively read image information from a document surface, enabling both sides of the document to be read in a single document conveyance. The document from which image information has been read is discharged to a document discharge portion 20. Further, the image reading apparatus 2 can read image information from a still document set on a platen glass, including a booklet document and the like that cannot be conveyed through the document feeder 3, by moving an image reading unit 16 in reciprocating movement by a driving device 17.

The image forming apparatus 1 is an electrophotographic apparatus that includes a direct transfer-type image forming unit 1B. The image forming unit 1B includes a cartridge 8 equipped with a photosensitive drum 9 and a laser scanner unit 15 arranged above the cartridge 8. When performing an image forming operation, a surface of the photosensitive drum 9 being rotated is charged before the photosensitive drum 9 is exposed by the laser scanner unit 15 based on image information, by which an electrostatic latent image is formed on the drum surface. The electrostatic latent image borne on the photosensitive drum 9 is developed into a toner image by charged toner particles, and the toner image is conveyed to a transfer portion where the photosensitive drum 9 opposes to a transfer roller 10. The control unit of the image forming apparatus 1 executes the image forming operation by the image forming unit 1B based on an image information read through the image reading units 16 and 19 or an image information received via the network from an outer computer.

The image forming apparatus 1 includes a plurality of feeding apparatuses 6 that feed sheets serving as recording materials one at a time at a predetermined interval. The sheets fed from the feeding apparatus 6 are subjected to skew feed correction at a registration roller 7 before being conveyed to a transfer portion, and the toner image borne on the photosensitive drum 9 is transferred to the sheets at the transfer portion. A fixing unit 11 is arranged downstream of the transfer portion in the sheet conveyance direction. The fixing unit 11 includes a rotary member pair that nips and conveys the sheet and a heating element such as a halogen lamp for heating the toner image, and performs an image fixing process by heating and pressing the toner image on the sheet.

In a case where the sheet on which the image has been formed is to be discharged to an exterior of the image forming apparatus 1, the sheet passing through the fixing unit 11 is conveyed via the horizontal conveyance portion 14 to the finisher 4. In a case where image formation on a first side of the sheet is completed during duplex printing, the sheet passing through the fixing unit 11 is transferred to a reverse conveyance roller 12, subjected to switch-back at the reverse conveyance roller 12 and conveyed again to the registration roller 7 via a reconveyance portion 13. The sheet passes through the transfer portion and the fixing unit 11 again to have an image formed on a second side before being passed through the horizontal conveyance portion 14 to be conveyed to the finisher 4.

The image forming unit 1B described above is an example of an image forming unit for forming an image on a sheet, and an intermediate transfer-type electrophotographic unit can be used for transferring a toner image formed on a photosensitive member via an intermediate transfer body to a sheet. An ink-jet type or offset-type printing unit can also be used as the image forming unit.

Finisher

The finisher 4 includes a punching mechanism 4A that performs a punching process to sheets and a binding mechanism 4B that performs a binding process of sheets, wherein the sheets received from the image forming apparatus 1 are subjected to punching and binding processes before being discharged as a sheet bundle. The finisher 4 can also simply discharge the sheets received from the image forming apparatus 1 without performing punching and binding processes thereto.

The finisher 4 includes a sheet receiving path 81, an intermediate sheet-discharge path 82, a first sheet discharge path 83 and a second sheet discharge path 84 serving as a conveyance path through which sheets are conveyed, and also includes an upper sheet discharge tray 25 and a lower sheet discharge tray 37 as discharge destinations to which the sheets are discharged. The sheet receiving path 81 serving as a first conveyance path is a conveyance path that receives sheets from the image forming apparatus 1 and conveys the same, and the intermediate sheet-discharge path 82 serving as a second conveyance path is a conveyance path that is extended below the sheet receiving path 81 for guiding the sheet toward the binding mechanism 4B. The first sheet discharge path 83 is a conveyance path through which the sheet is discharged to the upper sheet discharge tray 25, and the second sheet discharge path 84 serving as a third conveyance path is a conveyance path that extends along the sheet discharge direction for guiding the sheet to the lower sheet discharge tray 37.

The sheet discharged from the horizontal conveyance portion 14 of the image forming apparatus 1 is received by an inlet roller 21 serving as a conveyance portion arranged on the sheet receiving path 81, and conveyed through the sheet receiving path 81 toward a pre-reverse roller 22. An inlet sensor 27 detects a sheet at a detection position between the inlet roller 21 and the pre-reverse roller 22. The pre-reverse roller 22 conveys the sheet received from the inlet roller 21 toward the first sheet discharge path 83.

At a predetermined timing after the inlet sensor 27 has detected the passing of a trailing edge of the sheet, the pre-reverse roller 22 accelerates the conveyance speed of the sheet to a speed faster than the conveyance speed at the horizontal conveyance portion 14. It may also be possible to set the conveyance speed of the sheet by the inlet roller 21 greater than that by the horizontal conveyance portion 14, and the conveyance speed may be accelerated at the inlet roller 21 arranged upstream of the pre-reverse roller 22. In that case, a one-way clutch should preferably be arranged between a conveyance roller and a motor that drives the conveyance roller of the horizontal conveyance portion 14, so that the conveyance roller rotates idly when the sheet is pulled by the inlet roller 21.

In a case where the discharge destination of the sheet is the upper sheet discharge tray 25, a reverse conveyance roller 24 discharges the sheet received from the pre-reverse roller 22 to the upper sheet discharge tray 25. In this case, the reverse conveyance roller 24 is decelerated to a predetermined discharge speed at a predetermined timing after the trailing edge of the sheet has passed through the pre-reverse roller 22.

In a case where the discharge destination of the sheet is the lower sheet discharge tray 37, the reverse conveyance roller 24 serving as the reversing portion performs switch-back conveyance where the sheet received from the pre-reverse roller 22 is reversed, before the sheet is conveyed to the intermediate sheet-discharge path 82. A backflow prevention valve 23 is arranged at a branching portion upstream of the reverse conveyance roller 24 in the direction of discharge of the sheet by the reverse conveyance roller 24 where the sheet receiving path 81 and the intermediate sheet-discharge path 82 are branched from the first sheet discharge path 83. The backflow prevention valve 23 has a function to regulate the sheet subjected to switch-back by the reverse conveyance roller 24 from flowing back into the sheet receiving path 81. The direction of rotation of the pre-reverse roller 22 is reversed at a timing when the trailing edge of the sheet has passed through the backflow prevention valve 23.

An intermediate discharge roller 26, an intermediate conveyance roller 28 and a kick-out roller 29 serving as rotary member pairs that are arranged on the intermediate sheet-discharge path 82 sequentially transfer the sheet received from the reverse conveyance roller 24 and convey the sheet toward the binding mechanism 4B. If buffering of the sheet is to be performed, the intermediate discharge roller 26 stops temporarily while nipping a preceding sheet. Then, the intermediate discharge roller 26 rotates in the reverse direction in synchronization with a following sheet conveyed toward the reverse conveyance roller 24, and buffering is performed by overlapping the preceding sheet to the following sheet in a first sheet discharge path. A plurality of sheets can be buffered regardless of the length of the sheets, by repeating switch-back of the intermediate discharge roller 26.

An intermediate stacking pre-sensor 38 detects the sheet between the intermediate conveyance roller 28 and the kick-out roller 29. An optical sensor for detecting the presence or absence of a sheet at the detection position using light can be used as the inlet sensor 27 and the intermediate stacking pre-sensor 38.

The binding mechanism 4B includes an intermediate lower guide 32 serving as a supporting portion on which sheets are supported, an alignment mechanism 33 and a stapler not shown, wherein after aligning the sheets received from the intermediate sheet-discharge path 82 at the alignment mechanism 33, a predetermined position of the sheets are bound by the stapler. The sheet bundle bound by the binding mechanism 4B is transferred via the second sheet discharge path 84 to a bundle discharge roller 36, discharged to the exterior of the apparatus by the bundle discharge roller 36 serving as a sheet discharge portion and supported on the lower sheet discharge tray 37.

The upper sheet discharge tray 25 and the lower sheet discharge tray 37 are both movable in up and down directions with respect to the casing of the finisher 4. The finisher 4 includes a sheet surface detection sensor for detecting an upper surface position of the sheet at the upper sheet discharge tray 25 and the lower sheet discharge tray 37, and if either of the sensors detects the sheet, the tray corresponding to that sensor is lowered in the direction shown by arrow A2 or B2. If the removal of the sheet from the upper sheet discharge tray 25 or the lower sheet discharge tray 37 is detected by the sheet surface detection sensor, the tray is lifted in the direction shown by arrow A1 or B1. Thereby, the upper sheet discharge tray 25 and the lower sheet discharge tray 37 are subjected to lifting/lowering control so as to retain the upper surface of the sheet being supported thereon at a fixed level.

Punching Mechanism

Figure 2A:
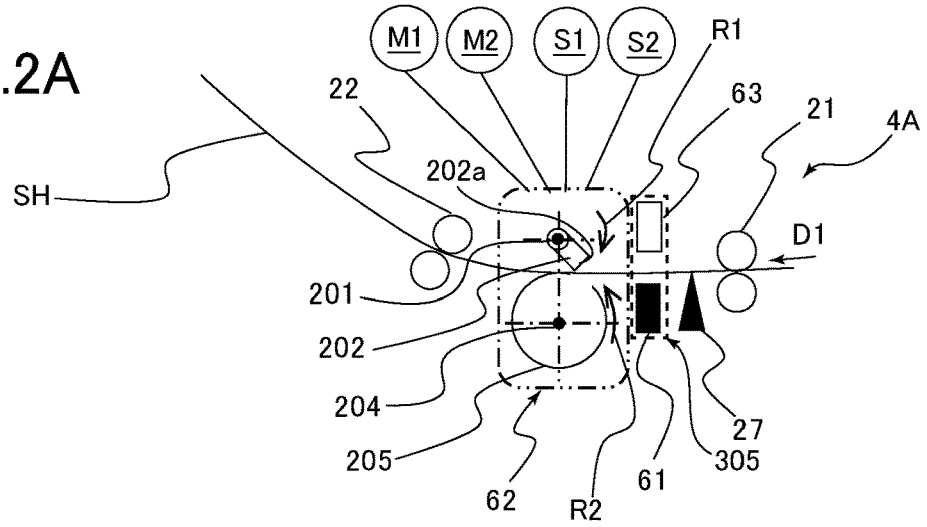
FIG. 2A is a schematic diagram illustrating a punch positioned at a punching start position.
Figure 2B:
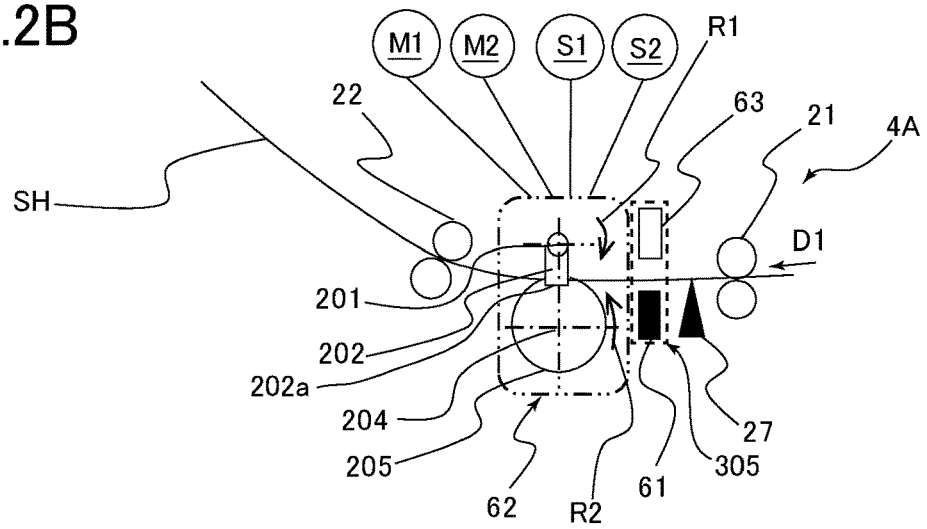
FIG. 2B is a schematic diagram illustrating a punch positioned at a punching complete position.
Figure 2C:
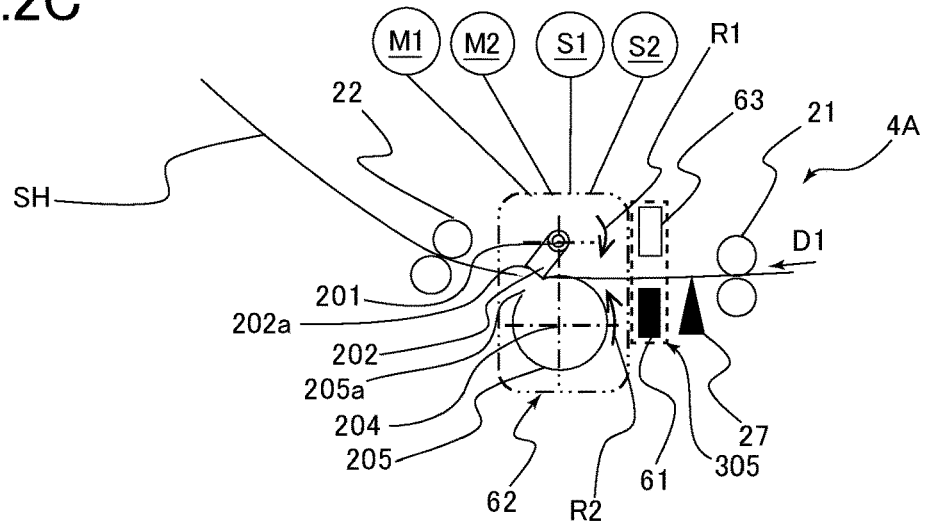
FIG. 2C is a schematic diagram illustrating a punch positioned at a separation position.

Next, the punching mechanism 4A will be described in detail. The punching mechanism 4A includes, as illustrated in FIGS. 2A to 2C, the inlet roller 21 for conveying a sheet SH in a sheet conveyance direction D1, the inlet sensor 27, a side edge detection unit 305, a punch unit 62 and a shift unit 400 (refer to FIG. 5A). The side edge detection unit 305 includes a lighting unit 63 and a line sensor 61, wherein the lighting unit 63 and the line sensor 61 are arranged opposed to one another with the sheet receiving path 81 interposed (refer to FIG. 1). The side edge detection unit 305 serving as a first detecting portion and a detecting portion is arranged upstream of the punch unit 62 in the sheet conveyance direction D1. The inlet sensor 27 serving as a second detecting portion is arranged upstream of the side edge detection unit 305 in the sheet conveyance direction D1, and a signal serving as an output value of the inlet sensor 27 is varied when a leading edge 506 (refer to FIG. 7A) which is an upstream edge of the sheet in the sheet conveyance direction D1 passes therethrough.

The line sensor 61 extends in a width direction of the sheet SH orthogonal to the sheet conveyance direction D1 and varies its output value based on the position of the edge portion of the sheet SH in the width direction. More specifically, the line sensor 61 is composed of an optical sensor, and the output value of the line sensor 61 is varied based on a boundary position of difference of density on the line sensor 61 that appears by the light irradiated from the light unit 63 being blocked by the sheet SH. Thereby, the position of the side edge of the sheet serving as an edge portion of the sheet SH in the width direction can be detected.

The punch unit 62 serving as a punching portion is a rotary-type punch unit that includes a punch 202 rotating in a direction of R1 around a shaft center 201 serving as an axis, and a die 205 that rotates in a direction of R2 that is opposite to the direction of R1 around a shaft center 204.

The punch 202 and the die 205 are rotated in synchronization by a punch motor M1 so that a blade edge 202*a* of the punch 202 fits to a hole portion 205*a* of the die 205. The punch motor M1 is configured to drive the blade edge 202*a* of the punch 202 so that a circumferential speed corresponds to a speed of the sheet SH in the sheet conveyance direction D1, by which punching is enabled while conveying the sheet SH. The punch motor M1 is composed of a stepping motor.

FIG. 2A is a schematic diagram illustrating a state where the punch 202 is positioned at a punching start position. FIG. 2B is a state in which the punch 202 is positioned at a punching complete position. FIG. 2C is a schematic diagram illustrating a state where the punch 202 is positioned at a separation position. The punch 202 rotating in the direction of R1 starts to contact the sheet SH at the punching start position and fits to the die 205 at the punching complete position. Then, the punch 202 is separated from the sheet SH at the separation position. Punching can be performed at various hole pitches to the sheet SH being conveyed by rotating the punch 202 at a predetermined timing after the leading edge of the sheet SH has been detected by the inlet sensor 27.

Punch Position Sensor

Figure 3:
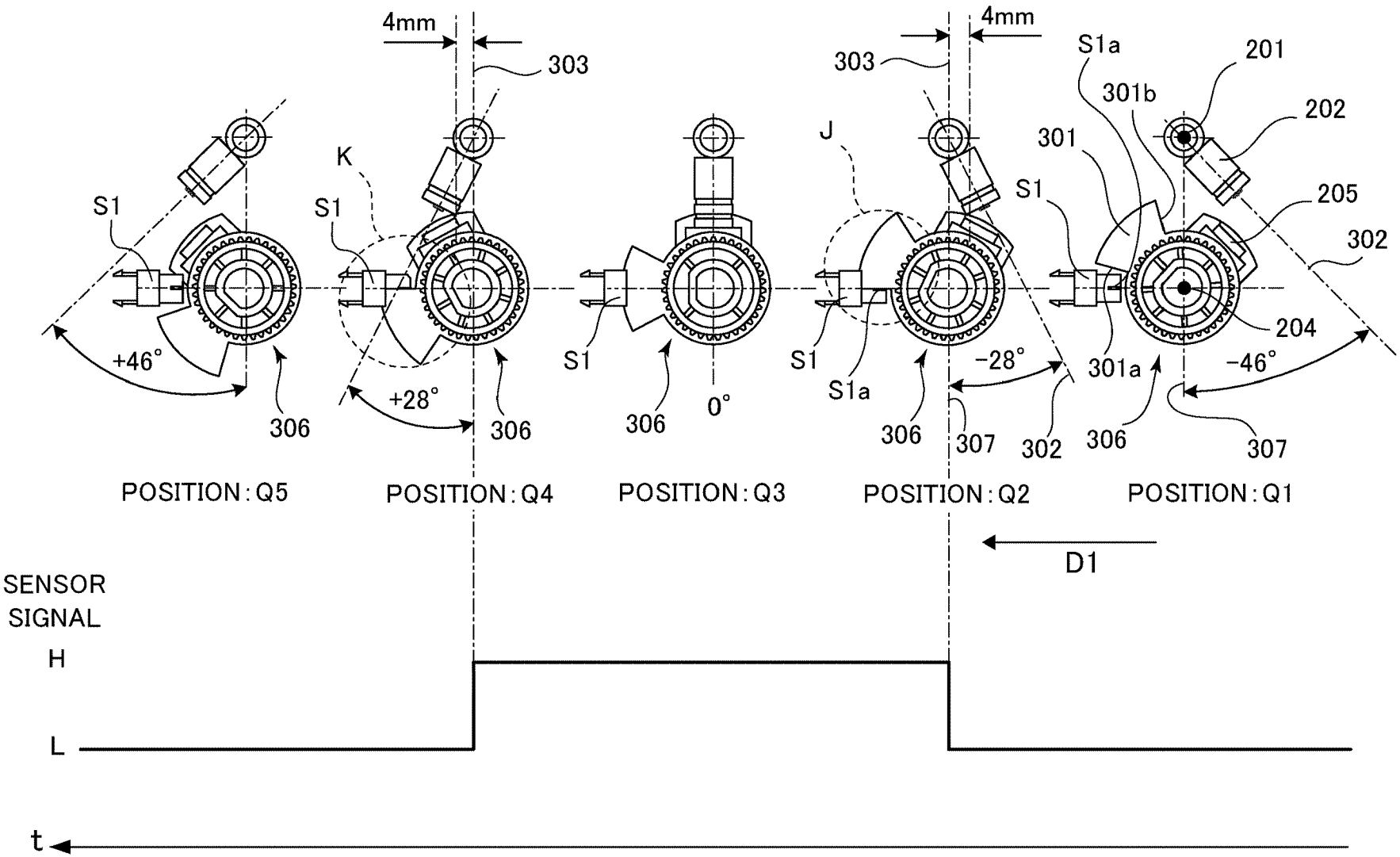
FIG. 3 is a view illustrating a relationship between respective rotational positions of the punch and punch position sensor signals.

Next, a rotational position detecting portion 306 provided on the punch unit 62 will be described in detail. FIG. 3 illustrates a relationship between respective rotational positions of the punch 202 and a signal of the punch position sensor S1. As illustrated in FIG. 3, the rotational position detecting portion 306 includes the punch position sensor S1 and a shielding plate 301 capable of shielding a slit S1*a* positioned at the detection position of the punch position sensor S1. The shielding plate 301 rotates around the shaft center 204 integrally with the die 205.

The punch 202 positioned at respective positions Q1 to Q5 and a peripheral configuration thereof are illustrated in FIG. 3. An angular representation of FIG. 3 indicates the angle, hereinafter referred to as punch angle, formed by a center line 302 of the punch 202 and a straight line 307 that connects the shaft center 201 of the punch 202 and the shaft center 204 of the die 205. A reference of the punch angle is set to a position where the center line 302 of the punch 202 corresponds to the straight line 307 (refer to position Q3), and a clockwise direction is set as a positive side.

In a state where the punch 202 is positioned at position Q1, the punch angle is set to −46°, and in this state, the punch 202 and the die 205 are not engaged. In a state where the punch 202 is positioned at position Q2, the punch angle is set to −28°, and this position corresponds to the above-mentioned punching start position (refer to FIG. 2A). A center portion of the punch 202 positioned at the punching start position is arranged upstream of the straight line 307 for 4 mm in the sheet conveyance direction D1.

In a state where the punch 202 is positioned at position Q3, the punch angle is set to 0°, and this position corresponds to the above-mentioned punching complete position (refer to FIG. 2B). In a state where the punch 202 is positioned at position Q4, the punch angle is set to +28°, and this position corresponds to the above-mentioned separation position (refer to FIG. 2B). The center position of the punch 202 positioned at the separation position is arranged downstream of the straight line 307 for 4 mm in the sheet conveyance direction D1. In a state where the punch 202 is positioned at position Q5, the punch angle is set to +46°, and in this state, the punch 202 and the die 205 are not engaged.

Next, the punch position sensor S1 will be described. A first role of the punch position sensor S1 is to determine a pulse origin of the punch 202. In the present embodiment, the signal of the punch position sensor S1 is switched in a state where the punch 202 is positioned at the punching start position, i.e., position Q2, and at that time, a pulse count of the punch motor M1 is set to zero. Thereby, pulse deviation can be calibrated.

Figure 4A:
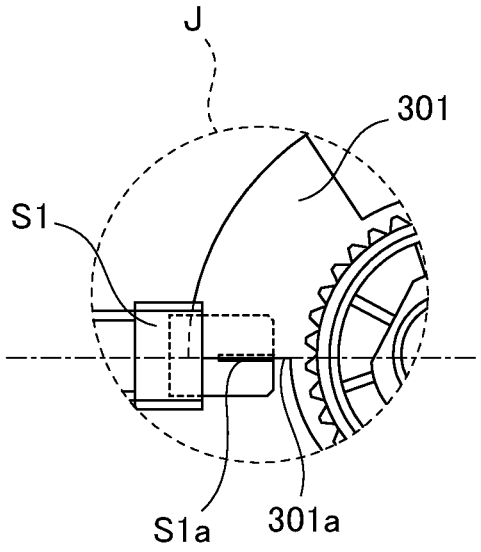
FIG. 4A is an enlarged view illustrating a broken line portion J of FIG. 3.

A second role of the punch position sensor S1 is to recognize whether the punch 202 is engaged with the die 205. FIG. 4A is an enlarged view of a broken line portion J of FIG. 3. As illustrated in FIG. 4A, when the punch 202 is positioned at the punching start position, i.e., position Q2, a first end portion 301*a* of the shielding plate 301 starts to shield the slit S1*a* of the punch position sensor S1. Thereby, the signal of the punch position sensor S1 is changed from level L, i.e., low level, to level H, i.e., high level, and the punch 202 starts to be engaged with the die 205.

Figure 4B:
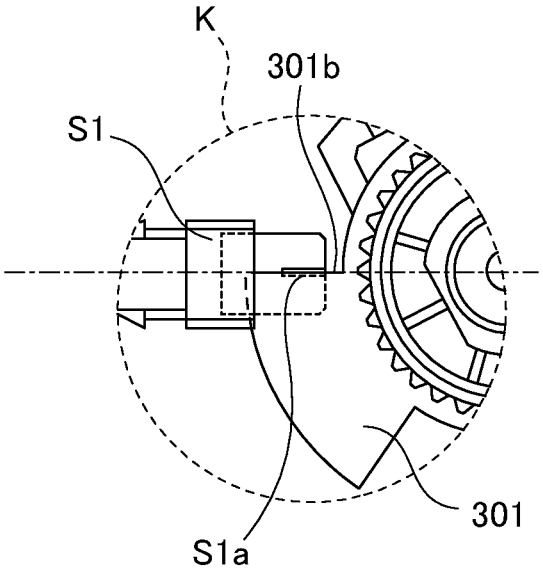
FIG. 4B is an enlarged view illustrating a broken line portion K of FIG. 3.

Further, FIG. 4B is an enlarged view of a broke line portion K of FIG. 3. As illustrated in FIG. 4B, when the punch 202 is positioned at the separation position, i.e., position Q4, a second end portion 301*b* of the shielding plate 301 cancels the shielded state of the slit S1*a* of the punch position sensor S1. Thereby, the signal of the punch position sensor S1 is changed from level H to level L, and the punch 202 starts to separate from the die 205.

When the punch 202 is positioned between the punching start position and the separation position, the punch 202 is engaged with the die 205 and subjects the sheet SH to a punching process, so that if the punch unit 62 is moved in the width direction, the sheet SH will be damaged. Therefore, based on the signal of the punch position sensor S1, when the punch 202 is positioned between the punching start position and the separation position, the punch unit 62 is prohibited from moving the width direction and the pre-reverse roller 22 is prohibited from being accelerated.

Further, when jamming occurs at the punch unit 62, whether the punch 202 is in contact with the sheet can be determined based on the signal of the punch position sensor S1. For example, in a state where the punch 202 is in contact with the sheet SH, a warning can be output to have the punch 202 removed from the area in contact with the sheet SH, and to alert the user by warning to encourage the user to rotate the punch 202 manually. Thereby, usability of the apparatus can be improved.

A third role of the punch position sensor S1 is to send out a trigger signal to accelerate conveyance of the sheet SH downstream in the sheet conveyance direction D1. When the punch 202 is positioned at the separation position, i.e., position Q4, the sheet SH and the punch 202 are separated, and the sheet SH can be pulled by the pre-reverse roller 22. As described, in a state where the punch 202 is positioned at the separation position, the signal of the punch position sensor S1 is changed from level H to level L.

As described, the rotational position detecting portion 306 serving as a third detecting portion including the punch position sensor S1 changes the output signal as the output value based on the position, in the direction of rotation, of the punch 202. The output value of the punch position sensor S1 varies between a period during which the punch 202 is separated from the sheet SH and a period during which the punch 202 is in contact with the sheet SH.

In the present embodiment, the shielding plate 301 is approximately fan-shaped, but the present invention is not limited to this example. For example, a configuration can be adopted where the shielding plate 301 is formed in a circular shape and slits are formed on the shielding plate 301 so that the signal of the punch position sensor S1 varies when the punch 202 is positioned at the punching start position, to thereby enable the position of the punch 202 to be managed using pulses. In that case, if physical association between the pulse and the shielding plate 301 is lost, for example due to turning off and on of power or step-out caused by jamming of the sheet, a home position signal must be searched by rotating the punch 202 and the die 205. The present embodiment did not adopt this configuration since it is difficult to judge whether there is a need to rotate the punch 202 manually if the punch 202 gets caught in the sheet by jamming or the like.

Shift Unit

Figure 5A:
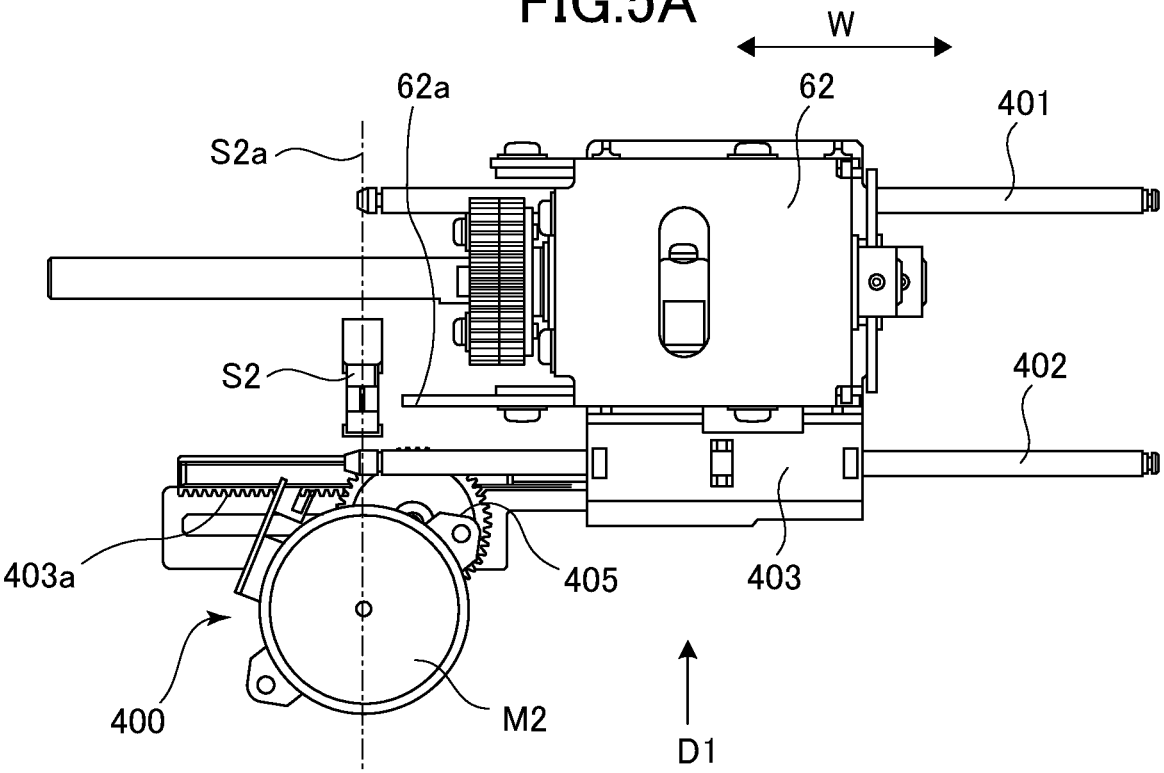
FIG. 5A is a plan view illustrating a punch unit and a shift unit.
Figure 5B:
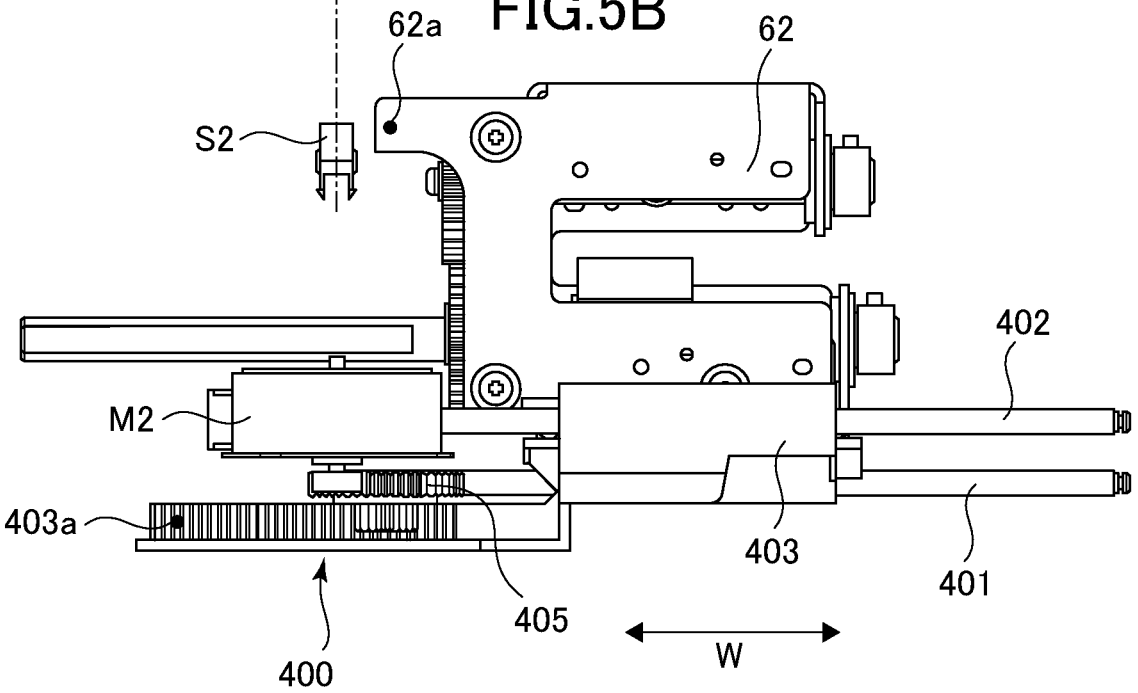
FIG. 5B is side view illustrating the punch unit and the shift unit.

Next, the shift unit 400 for shifting the punch unit 62 in a width direction W serving as an intersecting direction will be described in detail. In the present embodiment, the width direction W is a direction orthogonal to the sheet conveyance direction D1, but it can be set to any direction as long as it intersects the sheet conveyance direction D1. FIG. 5A is a plan view illustrating the punch unit 62 and the shift unit 400. FIG. 5B is a side view illustrating a state in which the punch unit 62 and the shift unit 400 are viewed in the sheet conveyance direction D1. The punch unit 62 is supported by a punch base portion 403, and the punch base portion 403 is supported movably on guide shafts 401 and 402 that extend in the width direction W. The punch base portion 403 includes a rack gear 403*a* that extends in the width direction W.

The shift unit 400 serving as a moving portion includes a shift motor M2 and an idler gear 405 that is rotated by the shift motor M2, wherein the idler gear 405 is engaged with the rack gear 403*a* of the punch base portion 403. The shift motor M2 is composed of a pulse motor, and when the shift motor M2 is driven, the punch unit 62 supported by the punch base portion 403 moves in the width direction W along the guide shafts 401 and 402.

The shift unit 400 includes a shift sensor S2, and the shift sensor S2 can detect a detected portion 62*a* provided on the punch unit 62. More specifically, the shift sensor S2 is an optical switch that includes a light emitter and a photodetector that are opposed to one another, and the signal of the shift sensor S2 is switched by the detected portion 62*a* blocking the space between the light emitter and the photodetector.

The punch unit 62 sets the position where the detected portion 62*a* enters a signal switch position S2*a* and the signal of the shift sensor S2 has been switched as a home position. The position of the punch unit 62 in the width direction W is managed by the number of pulses entered to the shift motor M2 with the home position set as the reference.

Control System

Figure 6:
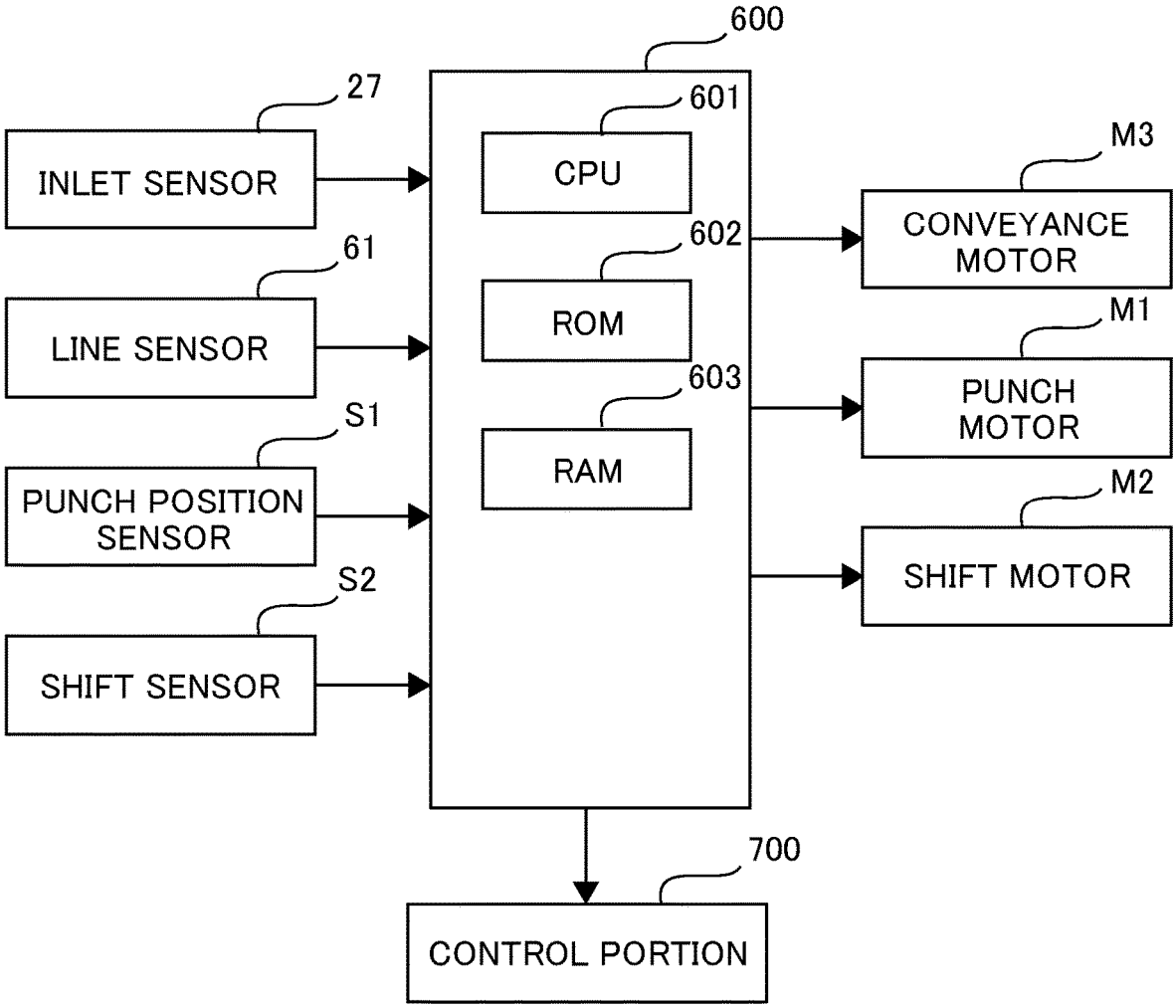
FIG. 6 is a block diagram illustrating a control system according to the present embodiment.

Next, a control system of the finisher 4 according to the present embodiment will be described. The finisher 4 includes a control unit 600 as illustrated in FIG. 6, and the control unit 600 includes a CPU 601, a ROM 602 and a RAM 603. The CPU 601 reads various programs stored in the ROM 602 and performs calculation. The RAM 603 is used as a work area of the CPU 601.

The inlet sensor 27, the line sensor 61, the punch position sensor S1 and the shift sensor S2 are connected to an input side of the control unit 600. A conveyance motor M3, the punch motor M1 and the shift motor M2 are connected to an output side of the control unit 600. The conveyance motor M3 drives the inlet roller 21. A control portion 700 including a liquid crystal panel, a physical button and the like is connected to the control unit 600, and various settings of the image forming system 1S can be changed through the control portion 700. Punching operation of the sheet SH is performed based on a command from the control portion 700 or an external computer connected to the image forming system 1S.

Punching Operation

Next, a punching operation performed to the sheet SH will be described. In the present embodiment, a case where the sheet SH is skewed is especially described as an example. In FIGS. 7A to 7D and FIGS. 8A to 8C, reference number 503 shows a center of the punch 202 in the punching complete position, hereinafter referred to as a punch center 503. Further, target positions 504 and 505 illustrated on the sheet SH are target positions of the holes to be punched by the punch 202, which are illustrated by broken lines. If punching is performed to the target positions 504 and 505, holes 604 and 605 will be illustrated by solid lines. The target position 504 serving as a first target position is positioned downstream in the sheet conveyance direction D1 of the target position 505 serving as a second target position, and it corresponds to the position of a first hole to be punched to the sheet SH. The target position 505 corresponds to the position of a second hole to be punched to the sheet SH.

Figure 7A:
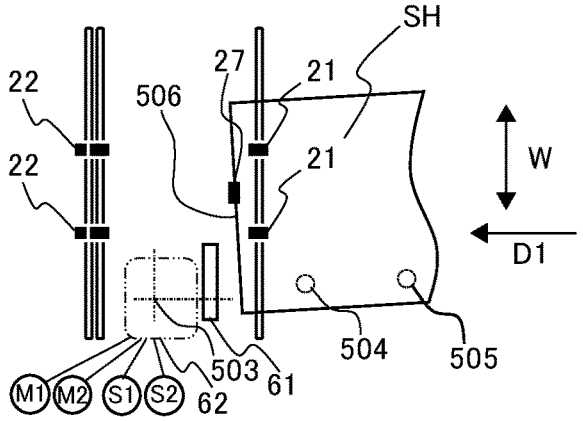
FIG. 7A is a plan view illustrating a state in which a leading edge of the sheet has reached an inlet sensor.

When a punching operation is started to punch the holes 604 and 605 to the sheet SH, as illustrated in FIG. 7A, the leading edge 506 of the sheet SH being conveyed by the inlet roller 21 is detected by the inlet sensor 27 and the signal of the inlet sensor 27 is switched. In this state, the holes 604 and 605 are not yet punched to the sheet SH, so they are illustrated by broken lines.

Figure 7B:
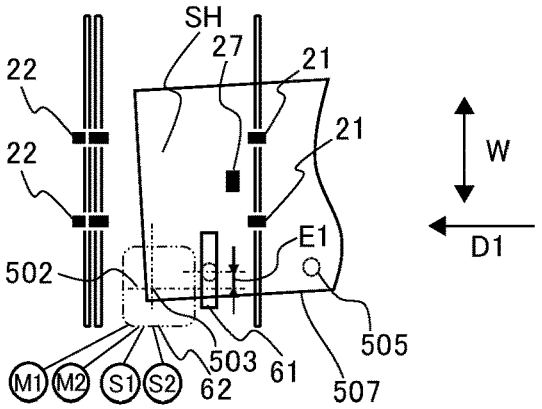
FIG. 7B is a plan view illustrating a state in which a target position of a hole has reached a line sensor.

When the sheet SH is further conveyed by the inlet roller 21, as illustrated in FIG. 7B, the target position 504 reaches the line sensor 61. In this state, the control unit 600 (refer to FIG. 6) outputs a command to the line sensor 61 to detect a side edge 507 serving as an edge portion in the width direction W of the sheet SH. The line sensor 61 detects the position of the side edge 507 in the width direction W of the sheet SH positioned at a position where the target position 504 ad the line sensor 61 overlap in the sheet conveyance direction D1 by detecting the difference in density at a boundary between the area covered by the sheet SH and the area not covered by the sheet.

The control unit 600 determines that the target position 504 has reached the line sensor 61 after a predetermined time has elapsed from the detection of the leading edge 506 of the sheet SH by the inlet sensor 27. The predetermined time is set according to the target position of the hole set in advance. Further, in a state where the sheet SH is skewed, the detection timing of the leading edge 506 is slightly varied compared to a case where the sheet SH is not skewed, but the error of the output value of the line sensor 61 based on this difference of detection timing is so small that it can be ignored.

The control unit 600 computes a moving distance E1 of the punch unit 62 based on the punch center 503 of the punch unit 62 whose position is managed by the shift sensor S2 and the shift motor M2 and the position of the side edge 507 detected by the line sensor 61. The moving distance E1 is a difference of distance in the width direction W between the punch center 503 and the position of the side edge 507 detected in FIG. 7B.

Figure 7C:
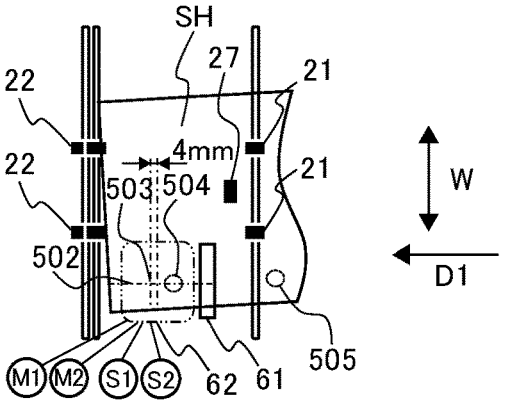
FIG. 7C is a plan view illustrating a state in which the sheet has been moved in a width direction.

Next, the control unit 600 moves the punch unit 62 in the width direction W for a distance corresponding to the moving distance E1 by driving the shift motor M2, as illustrated in FIGS. 7B and 7C, and aligns the punch center 503 and the target position 504 in the width direction W. In order for the punch 202 to be at the punching complete position in the target position 504, the punch 202 must be set at the punching start position when the target position 504 is positioned upstream for 4 mm in the sheet conveyance direction D1 from the punch center 503. Therefore, in FIG. 7C, the punch 202 is not yet in contact with the sheet SH, and the signal of the punch position sensor S1 is set to level L (refer to FIG. 3).

Figure 7D:
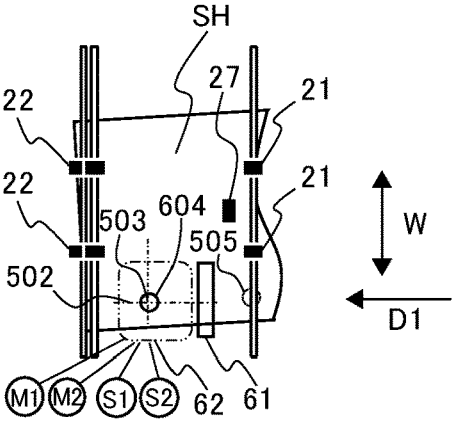
FIG. 7D is a plan view illustrating a state in which the sheet has been punched.

FIG. 7D is a plan view illustrating a state where the punch center 503 corresponds to the target position 504 and the hole 604 has been punched by the punch 202. In this state, the punch 202 is positioned at the punching complete position, and the orientations of the punch 202 and the die 205 are the same as the state illustrated in FIG. 2B.

Figure 8A:
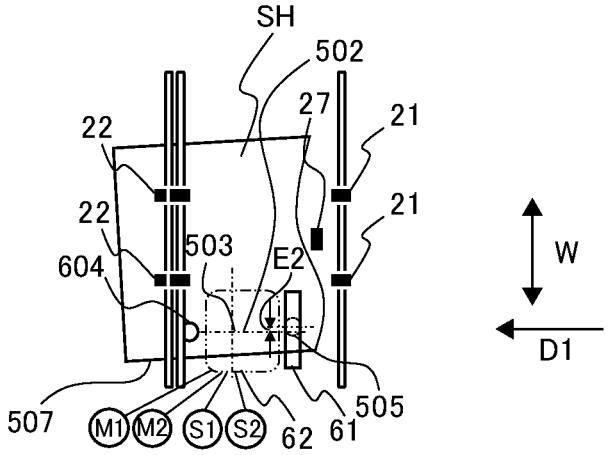
FIG. 8A is a plan view illustrating a state in which a target position of a second hole has reached the line sensor.

In a state where the sheet SH is conveyed further by the inlet roller 21, as illustrated in FIG. 8A, the target position 505 reaches the line sensor 61. In this state, the control unit 600 (refer to FIG. 6) outputs a command to the line sensor 61 to detect the side edge 507 of the sheet SH. The line sensor 61 detects the position of the side edge 507 of the sheet SH in the width direction W which is positioned where the target position 505 and the line sensor 61 overlap in the sheet conveyance direction D1 by detecting the difference of density at the boundary between the area covered by the sheet SH and the area not covered by the sheet SH.

Then, the control unit 600 calculates a moving distance E2 of the punch unit 62 based on the punch center 503 of the punch unit 62 and the position of the side edge 507 detected by the line sensor 61. The moving distance E2 is a difference in the width direction W of positions of the punch center 503 and the side edge 507 detected in FIG. 8A.

Figure 8B:
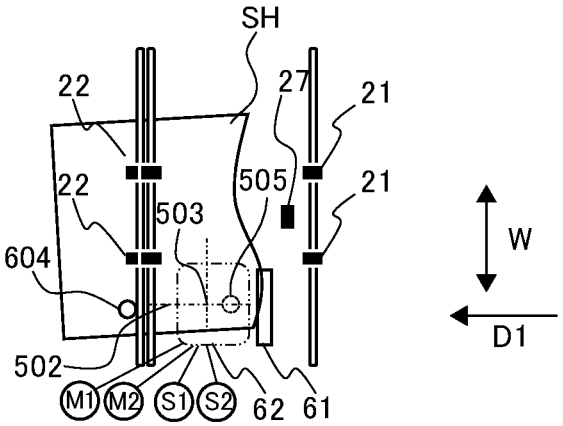
FIG. 8B is a plan view illustrating a state in which the sheet has been moved in the width direction.

Next, the control unit 600 moves the punch unit 62 for a distance corresponding to the moving distance E2 in the width direction W by driving the shift motor M2, as illustrated in FIGS. 8A and 8B, and aligns the positions of the punch center 503 and the target position 505 in the width direction W. The movement of the punch unit 62 in the width direction W is completed before the blade edge 202*a* (refer to FIG. 2A) of the punch 202 that rotates by the punch motor M1 contacts the sheet SH.

Figure 8C:
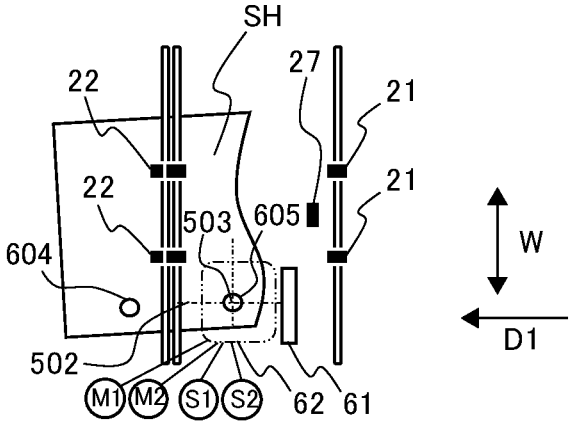
FIG. 8C is a plan view illustrating a state in which the sheet has been punched.

FIG. 8C is a plan view illustrating a state where the punch center 503 corresponds to the target position 505 and the hole 605 has been punched by the punch 202. The punching operation for punching the holes 604 and 605 to the sheet SH is completed as described, but if three or more holes must be punched to the sheet SH, the operation described above is repeated.

Figure 9A:
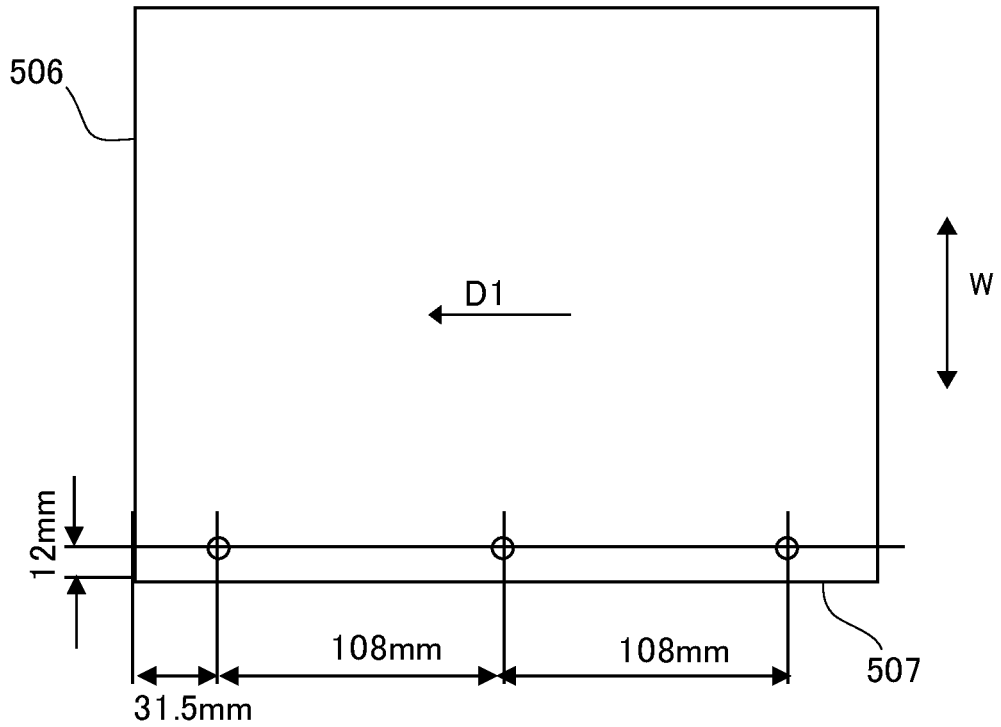
FIG. 9A is a plan view illustrating an example of an LTR size sheet to which three holes are punched.

FIG. 9A is a plan view illustrating an example of an LTR size (216 mm×279 mm) sheet to which three holes are punched. In this example, a hole diameter is set to 8 mm, and a distance between the side edge 507 of the sheet and the center of the hole in the width direction W is set to 12 mm. A distance from the leading edge 506 of the sheet to a center of a first hole in the sheet conveyance direction D1 is set to 31.5 mm, and a distance from a center of the first hole to a center of a second hole in the sheet conveyance direction D1 is set to 108 mm. A distance from the center of the second hole to a center of a third hole in the sheet conveyance direction D1 is also set to 108 mm.

Figure 9B:
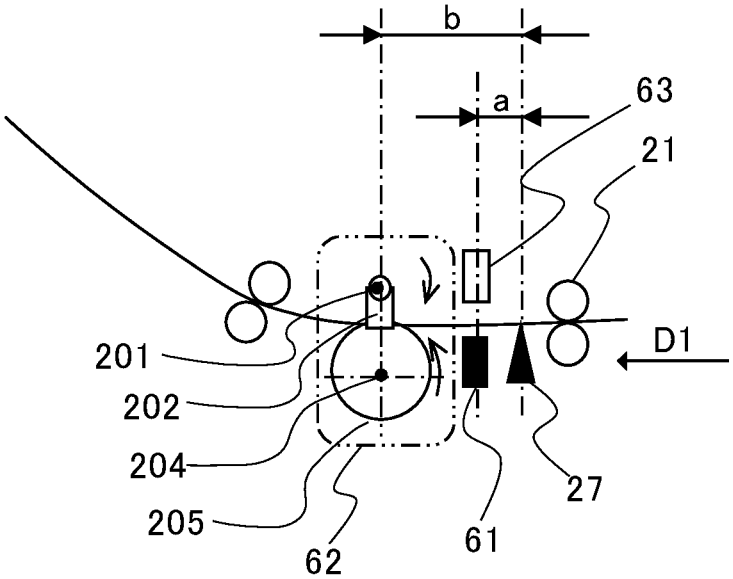
FIG. 9B is a schematic diagram illustrating a positional relationship of the inlet sensor and the line sensor.

FIG. 9B is a view illustrating a positional relationship between the inlet sensor 27 and the line sensor 61. In the sheet conveyance direction D1, the inlet sensor 27 and the line sensor 61 are separated by distance a, and the inlet sensor 27 and the shaft center 201 of the punch 202 are separated by distance b.

Next, a punching operation for punching three holes to an LTR-size sheet will be described with reference to a time chart of FIG. 10. In the following description, an example is illustrated where the dimensions of the sheet and three holes are set to the values illustrated in FIG. 9A, with distance a set to 10 mm and distance b set to 60 mm.

Figure 10:
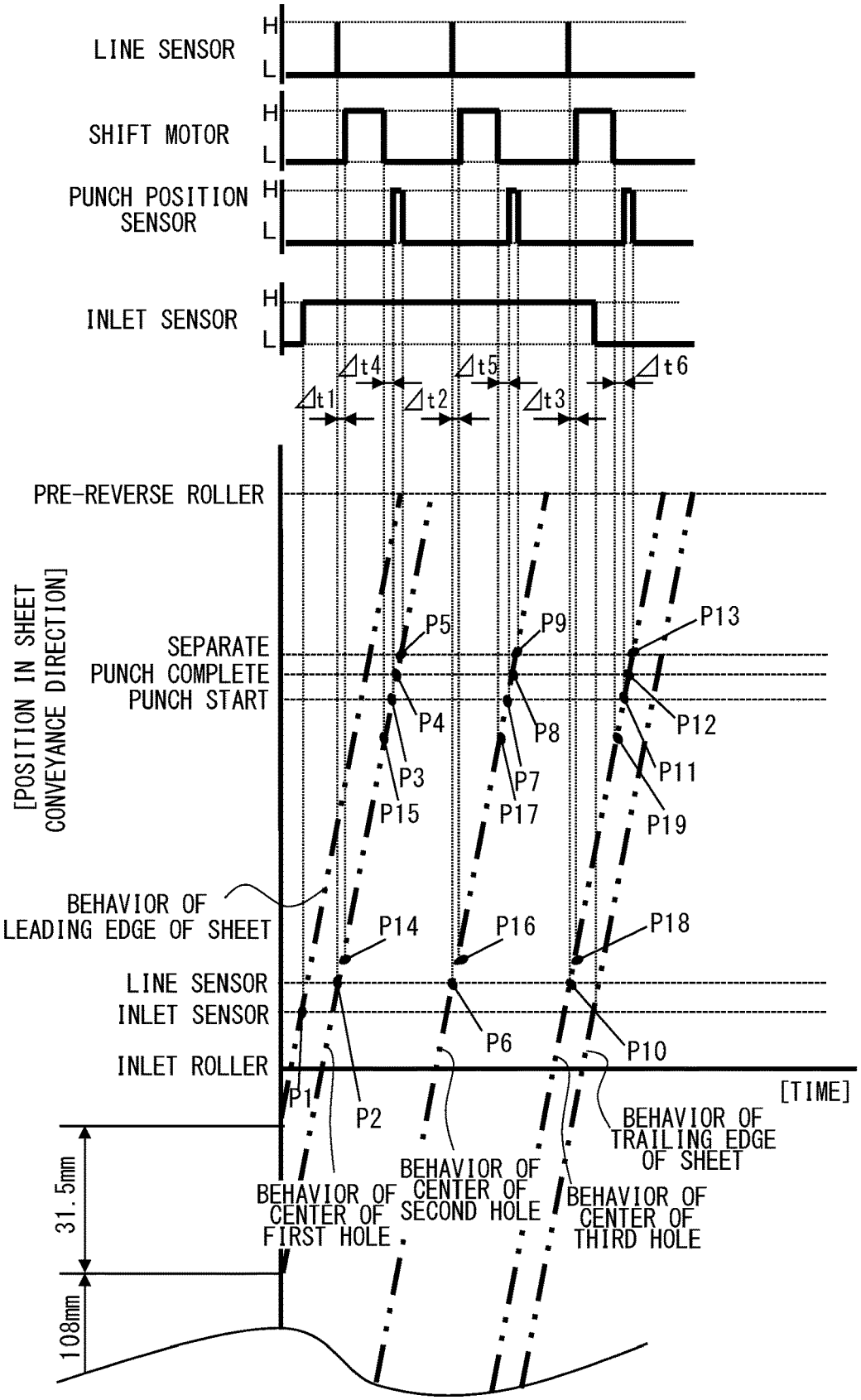
FIG. 10 is a view illustrating a behavior of a sheet, and states of signals of the inlet sensor, the punch position sensor, a shift motor and the line sensor.

FIG. 10 illustrates a behavior of a sheet and the states of signals of the inlet sensor 27, the punch position sensor S1, the shift motor M2 and the line sensor 61 shown in one diagram. A horizontal axis of the timing chart illustrating the behavior of the sheet shows time, and the vertical axis shows the position of the sheet in the sheet conveyance direction D1. A plurality of two-dot chain lines illustrated in the timing chart respectively indicate the behaviors of the leading edge 506 of the sheet, the center of the first hole, the center of the second hole and the center of the third hole on the sheet, and the trailing edge of the sheet.

If there is no sheet at the detection position of the inlet sensor 27, the inlet sensor 27 outputs a level L signal, and if there is a sheet at the detection position, it outputs a level H signal. If the punch 202 is separated from the sheet being conveyed and the die 205, the punch position sensor S1 outputs a level L signal, and if the punch 202 is in contact with the sheet being conveyed and the die 205, the punch position sensor S1 outputs a level H signal.

The shift motor M2 is not driven when the level L signal is output to the shift motor M2, and it is driven when the level H signal is output to the shift motor M2. The line sensor 61 does not perform scanning when the level L signal is output to the line sensor 61 and performs scanning when the level H signal is output to the line sensor 61.

At first, the sheet transferred from the image forming apparatus 1 to the finisher 4 is conveyed by the inlet roller 21 and the leading edge 506 of the sheet reaches the inlet sensor 27 (point P1). In this state, the inlet sensor 27 detects the leading edge 506 of the sheet. In a case where the center of target position of the first hole, hereinafter referred to as center of first hole, reaches the line sensor 61, the side edge 507 of the sheet is detected by the line sensor 61 (point P2). In other words, in a state where the center of first hole of the sheet reaches the line sensor 61, a detection processing of detecting the side edge 507 of the sheet by the line sensor 61 is executed. Then, the control unit 600 calculates the moving distance E1 based on the difference between a position of the side edge 507 detected by the line sensor 61, i.e., output value, and a position of the center of first hole in the width direction W.

The control unit 600 starts to drive the shift motor M2 at a time point of point P14 to move the punch unit 62 in the width direction W and ends the drive of the shift motor M2 at a time point of point P15. Symbol Δt1 refers to a time from detection of position of the side edge 507 of the sheet by the line sensor 61 to starting of movement of the punch unit 62 in the width direction W. Then, the punch 202 positioned at the punching start position contacts the sheet (point P3). Symbol Δt4 refers to a time from completion of movement of the punch unit 62 in the width direction W by the punch unit 62 to starting of punching of the sheet by the punch 202. That is, the punching process of the sheet by the punch 202 is executed after the moving process of moving the punch unit 62 in the width direction W by the shift motor M2 has been completed.

Further, punching is performed to the target position of the first hole on the sheet by the punch 202 having reached the punching complete position (point P4). Then, the punch 202 having reached the separation position is separated from the sheet (point P5).

Next, in a state where the center of target position of the second hole, hereinafter referred to as center of second hole, reaches the line sensor 61, the side edge 507 of the sheet is detected by the line sensor 61 (point P6). Then, the control unit 600 calculates the moving distance E2 based on the difference between a position of the side edge 507 detected by the line sensor 61 and a position of the center of second hole in the width direction W.

The control unit 600 starts to drive the shift motor M2 at a time point of point P16 to move the punch unit 62 in the width direction W, and ends the drive of the shift motor M2 at a time point of point P17. Symbol Δt2 refers to a time from the detection of position of the side edge 507 of the sheet by the line sensor 61 to starting of movement of the punch unit 62 in the width direction W. Then, the punch 202 positioned at the punching start position contacts the sheet (point P7). Symbol Δt5 refers to a time from the completion of movement of the punch unit 62 in the width direction W to starting of punching of the sheet by the punch 202. That is, movement of the punch unit 62 in the width direction W by the shift motor M2 is completed before the punch 202 contacts the sheet.

Further, the punch 202 having reached the punching complete position performs punching to a target position of the second hole on the sheet (point P8). Then, the punch 202 having reached the separation position separates from the sheet (point P9).

Next, in a state where the center of target position of the third hole, hereinafter referred to as center of third hole, reaches the line sensor 61, the side edge 507 of the sheet is detected by the line sensor 61 (point P10). Then, the control unit 600 calculates a moving distance E3 based on the difference between a position of the side edge 507 detected by the line sensor 61 and a position of the center of third hole in the width direction W.

The control unit 600 starts to drive the shift motor M2 at a time point of point P18 to move the punch unit 62 in the width direction W and ends the drive of the shift motor M2 at a time point of point P19. Symbol Δt3 refers to a time from detection of position of the side edge 507 of the sheet by the line sensor 61 to starting of movement of the punch unit 62 in the width direction W. Then, the punch 202 positioned at the punching start position contacts the sheet (point P11). Symbol Δt6 refers to a time from completion of movement of the punch unit 62 in the width direction W to starting of punching of the sheet by the punch 202. That is, movement of the punch unit 62 in the width direction W by the shift motor M2 is completed before the punch 202 contacts the sheet.

Further, the punch 202 having reached the punching complete position performs punching to a target position of the third hole on the sheet (point P12). Then, the punch 202 having reached the separation position is separated from the sheet (point P13).

As described, the control unit 600 causes the side edge detection unit 305 including the line sensor 61 to execute the detection process of detecting the side edge 507 of the sheet for a target position of each of the plurality of holes to be formed to a single sheet. Then, the control unit 600 executes the moving process of driving the shift unit 400 by calculating the moving distance of the punch unit 62 based on the signal output serving as an output value from the side edge detection unit 305 corresponding to the target position. After the moving process, the control unit 600 executes the punching process of performing punching to the target position of the sheet by the punch unit 62.

In other words, when performing punching to the target positions 504 and 505 of a single sheet, at first, the control unit 600 executes a first moving process of moving the shift unit 400 based on the first output value of the side edge detection unit 305 including the line sensor 61. Next, the control unit 600 executes a first punching process of performing punching to the target position 504 of the sheet by the punch unit 62. The control unit 600 executes a second moving process of moving the shift unit 400 based on a second output value of the side edge detection unit 305 after the first moving process. Next, the control unit 600 executes a second punching process of performing punching to the target position 505 of the sheet by the punch unit 62.

As described, the finisher 4 according to the present embodiment does not include a skew feed correction mechanism for correcting skewing of the sheet during the punching operation of punching the sheet by the punch unit 62. Instead, the punch unit 62 is moved in the width direction W by the shift unit 400 to enable punching to be performed highly accurately to target positions on the sheet even if the sheet is skewed.

Since the present embodiment does not include a skew feed correction mechanism, the costs of the apparatus can be cut down. In a skew feed correction mechanism for correcting the skewing of sheets, it is common to abut the leading edge of the sheet on a skew feed correction member to form a loop on the sheet, but a striking sound is generated when the sheet contacts the skew feed correction member. However, the present embodiment does not have a skew feed correction mechanism, so that striking sounds do not occur, and noise suppressing property of the apparatus can be enhanced. Damages that may occur to the leading edge of the sheet can be reduced. Further, highly accurate punching can be performed to thick sheets and other sheets that cannot be easily looped for skew feed correction.

Second Embodiment

Next, a second embodiment of the present invention will be described. The second embodiment adopts a configuration where the inlet sensor 27 of the first embodiment is omitted. The components similar to the first embodiment are either not shown in the drawings or denoted with the same reference numbers as the first embodiment in the description.

Figure 11:
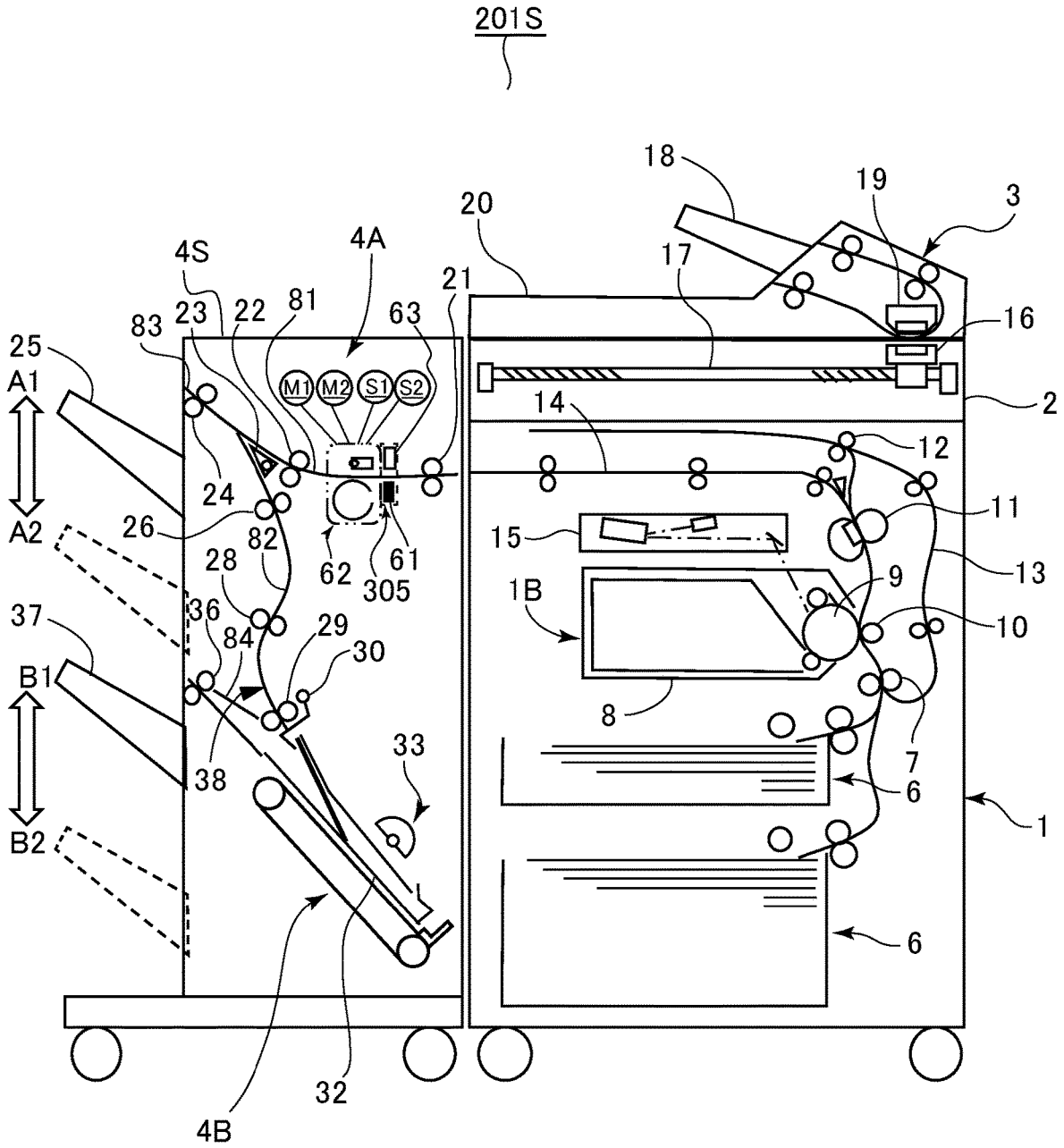
FIG. 11 is an entire schematic diagram illustrating an image forming system according to a second embodiment.

An image forming system 201S according to the second embodiment is composed of the image forming apparatus 1, the image reading apparatus 2, the document feeder 3 and a finisher 4S, as illustrated in FIG. 11. The finisher 4S is configured by omitting the inlet sensor 27 from the finisher 4 (refer to FIG. 1) of the first embodiment.

According to the configuration of the finisher 4S, the line sensor 61 is constantly set to scanning mode to detect the leading edge of the sheet by the line sensor 61. That is, the line sensor 61 also takes on the role of the inlet sensor 27. The punching operation according to the present embodiment is similar to the first embodiment other than the configuration that the leading edge of the sheet is detected by the line sensor 61 instead of the inlet sensor 27, so the descriptions thereof will be omitted.

As described, costs can be cut down according to the present embodiment since the punching operation can be performed similarly as the first embodiment by omitting the inlet sensor 27.

Other Embodiments

According to the first and second embodiments described above, the finisher 4 directly connected to the image forming apparatus 1 was illustrated as an example of the sheet processing apparatus. However, the present technique is also applicable to a sheet processing apparatus that receives sheets from the image forming apparatus 1 through an intermediate unit, such as a relay conveyance unit that is attached to a sheet discharge space in an image forming apparatus that adopts an in-body sheet discharge system. Further, the image forming system including the sheet processing apparatus and the image forming apparatus includes a system where a module having the functions of the image forming apparatus 1 and the finisher 4 is installed in a single casing. Further, a configuration can be adopted where the control unit 600 is disposed in the image forming apparatus 1, and the finisher 4 is controlled by the control unit 600 disposed in the image forming apparatus 1.

According to the illustrated embodiments, the detection of the side edge 507 of the sheet was performed using the line sensor 61, but the present invention is not limited thereto. For example, the position of the side edge 507 of the sheet can be detected using an imaging unit such as a CCD instead of the line sensor 61.

According to the illustrated embodiments, a rotary-type punch unit 62 was adopted, but the present invention is not limited thereto. For example, a punch unit that performs punching to the sheet by moving in reciprocating motion in an axial direction of the punch can be adopted instead of the rotary-type punch unit.

According to the illustrated embodiments, the punching process was executed to a sheet being conveyed by the inlet roller 21, but the present invention is not limited thereto. For example, the inlet roller 21 can be controlled so that conveyance of the sheet is temporarily stopped when performing the punching process to the sheet by the punch unit 62 and resuming conveyance of the sheet after the punching process has been completed.

Further, according to the illustrated embodiments, the respective sensors were illustrated to output electric signals as output values, but the present invention is not limited thereto, and detection by sensors can be performed, for example, based on the change of voltage or current of the circuit to which the sensors are connected.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-188138, filed Oct. 11, 2019, which is hereby incorporated by reference herein in its entirety.

What is claimed is:

1. A sheet processing apparatus comprising:

a conveyance portion configured to convey a sheet in a sheet conveyance direction;

a punching portion configured to perform punching to the sheet conveyed by the conveyance portion, the punching portion comprising a punch that rotates around an axis extending in an intersecting direction intersecting the sheet conveyance direction;

a moving portion configured to move the punching portion toward the intersecting direction;

a first detecting portion arranged upstream of the punching portion in the sheet conveyance direction and configured to perform a detection process of outputting an output value based on a position of an edge portion in the intersecting direction of the sheet being conveyed, the first detecting portion being disposed in a position corresponding to the edge portion of the sheet; and a control unit configured to control the conveyance portion, the punching portion and the moving portion, wherein during punching performed to a first target position and a second target position of a single sheet, the control unit is configured to execute a first moving process of moving the punching portion in the intersecting direction by the moving portion while the sheet is being conveyed by the conveyance portion in the sheet conveyance direction based on a first output value of the first detecting portion, a first punching process of performing punching to the first target position of the sheet, being conveyed by the conveyance portion, by the punching portion which has moved in the first moving process, a second moving process of moving the punching portion in the intersecting direction by the moving portion while the sheet is being conveyed by the conveyance portion in the sheet conveyance direction based on a second output value of the first detecting portion after the first moving process, and a second punching process of performing punching to the second target position of the sheet, being conveyed by the conveyance portion, by the punching portion which has moved in the second moving process.

2. The sheet processing apparatus according to claim 1, wherein the first detecting portion executes the detection process when the first target position and the second target position of the sheet being conveyed respectively reaches the first detecting portion.

3. The sheet processing apparatus according to claim 2, wherein the control unit is configured to calculate a moving distance of the punching portion in the first moving process based on the first output value and a position of the first target position in the intersecting direction, and to calculate a moving distance of the punching portion in the second moving process based on the second output value and a position of the second target position in the intersecting direction.

4. The sheet processing apparatus according to claim 1, further comprising a second detecting portion that is arranged upstream of the first detecting portion in the sheet conveyance direction and that is configured to change an output value in a case where an upstream edge, in the sheet conveyance direction, of the sheet being conveyed passes through the second detecting portion.

5. The sheet processing apparatus according to claim 1, wherein when viewed in a direction orthogonal to the sheet conveyance direction and the intersecting direction, the first detecting portion overlaps the first target position in a case where the first detecting portion outputs the first output value, and overlaps the second target position in a case where the first detecting portion outputs the second output value.

6. The sheet processing apparatus according to claim 1, further comprising a third detecting portion configured to change an output value based on a position, in a direction of rotation, of the punch.

7. The sheet processing apparatus according to claim 6, wherein the output value of the third detecting portion varies between a period in which the punch is separated from the sheet and a period in which the punch is in contact with the sheet.

8. The sheet processing apparatus according to claim 1, further comprising:

a first conveyance path configured to receive the sheet;

a reversing portion configured to reverse the sheet received from the first conveyance path;

a supporting portion on which the sheet reversed by the reversing portion is supported;

a second conveyance path extending below the first conveyance path, the second conveyance path being configured to receive the sheet reversed by the reversing portion and guide the sheet to the supporting portion;

a sheet discharge portion configured to discharge the sheet to an exterior of the sheet processing apparatus;

a third conveyance path extending toward the sheet discharge portion from the supporting portion and configured to guide the sheet to the sheet discharge portion; and a rotary member pair arranged in the second conveyance path and configured to discharge the sheet to the supporting portion.

9. The sheet processing apparatus according to claim 8, wherein the punching portion is arranged in the first conveyance path.

10. The sheet processing apparatus according to claim 1, the first detecting portion comprises a line sensor which extends in the intersecting direction, wherein there is no line sensor at a position corresponding to a second edge portion, opposing to a first edge portion as the edge portion in the intersecting direction, of the sheet.

11. An image forming system comprising:

an image forming unit configured to form an image on a sheet;

a conveyance portion configured to convey the sheet on which the image has been formed by the image forming unit in a sheet conveyance direction;

a punching portion configured to perform punching to the sheet conveyed by the conveyance portion, the punching portion comprising a punch that rotates around an axis extending in an intersecting direction intersecting the sheet conveyance direction;

a moving portion configured to move the punching portion toward the intersecting direction;

a first detecting portion arranged upstream of the punching portion in the sheet conveyance direction and configured to perform a detection process of outputting an output value based on a position of an edge portion in the intersecting direction of the sheet being conveyed, the first detecting portion being disposed in a position corresponding to the edge portion of the sheet; and a control unit configured to control the conveyance portion, the punching portion and the moving portion, wherein during punching performed to a first target position and a second target position of a single sheet, the control unit is configured to execute a first moving process of moving the punching portion in the intersecting direction by the moving portion while the sheet is being conveyed by the conveyance portion in the sheet conveyance direction based on a first output value of the first detecting portion, a first punching process of performing punching to the first target position of the sheet, being conveyed by the conveyance portion, by the punching portion which has moved in the first moving process, a second moving process of moving the punching portion in the intersecting direction by the moving portion while the sheet is being conveyed by the conveyance portion in the sheet conveyance direction based on a second output value of the first detecting portion after the first moving process, and a second punching process of performing punching to the second target position of the sheet, being conveyed by the conveyance portion, by the punching portion which has moved in the second moving process.

* * * * *